US005691127A

United States Patent [19]

Daubendiek et al.

[11] Patent Number: 5,691,127

[45] Date of Patent: *Nov. 25, 1997

[54] EPITAXIALLY SENSITIZED ULTRATHIN TABULAR GRAIN EMULSIONS CONTAINING STABILIZING ADDENDA

[75] Inventors: Richard Lee Daubendiek; Timothy Richard Gersey; Robert Don Wilson; Joseph George Lighthouse; Joseph Charles Deaton, all of Rochester; Myra Toffolon Olm; Donald Lee Black, both of Webster; Xin Wen, Rochester, all of N.Y.

[73] Assignee: Eastman Kodak Company, Rochester, N.Y.

[ * ] Notice: The term of this patent shall not extend beyond the expiration date of Pat. No. 5,503,971.

[21] Appl. No.: 595,679

[22] Filed: Feb. 2, 1996

[51] Int. Cl.[6] ..... G03C 1/035; G03C 1/09; G03C 1/34

[52] U.S. Cl. ..... 430/567; 430/614; 430/615; 430/611; 430/605

[58] Field of Search ..... 430/567, 614, 430/615, 611, 605

[56] References Cited

U.S. PATENT DOCUMENTS

| | | | |
|---|---|---|---|
| 2,597,915 | 5/1952 | Yutzy et al. . | |
| 4,332,884 | 6/1982 | Uji-Ie et al. . | |
| 4,332,888 | 6/1982 | Corben | 430/570 |
| 4,434,501 | 2/1984 | Pfeiffer . | |
| 4,439,520 | 3/1984 | Kofron et al. | 430/434 |
| 4,578,348 | 3/1986 | Freeman et al. . | |
| 4,888,273 | 12/1989 | Himmelwright et al. . | |
| 5,219,721 | 6/1993 | Klaus et al. . | |
| 5,250,403 | 10/1993 | Antoniades et al. | 430/505 |
| 5,275,930 | 1/1994 | Maskasky | 430/567 |
| 5,399,477 | 3/1995 | Maskasky | 430/567 |
| 5,494,789 | 2/1996 | Daubendiek et al. . | |
| 5,503,970 | 4/1996 | Olm et al. . | |
| 5,503,971 | 4/1996 | Daubendiek et al. . | |
| 5,536,632 | 7/1996 | Wen et al. | 430/567 |
| 5,576,168 | 11/1996 | Daubendiek et al. | 430/567 |
| 5,576,172 | 11/1996 | Olm et al. | 430/567 |
| 5,582,965 | 12/1996 | Deaton et al. | 430/567 |
| 5,614,358 | 3/1997 | Wilson et al. | 430/567 |
| 5,629,144 | 5/1997 | Daubendiek et al. | 430/567 |
| 5,631,126 | 5/1997 | Daubendiek et al. | 430/567 |

OTHER PUBLICATIONS

Research Disclosure 308119, Dec. 1989.

Research Disclosure 36544, Sep. 1994.

*Primary Examiner*—Mark F. Huff

*Attorney, Agent, or Firm*—Paul A. Leipold

[57] ABSTRACT

The invention relates to an emulsion comprising silver halide grains, said grains being tabular and comprising sensitizing dye(s) and silver salt epitaxial deposits, and addenda that include a mercaptotetrazole and a tetraazaindene.

20 Claims, No Drawings

EPITAXIALLY SENSITIZED ULTRATHIN TABULAR GRAIN EMULSIONS CONTAINING STABILIZING ADDENDA

FIELD OF THE INVENTION

This invention relates to silver halide photographic emulsions, specifically to epitaxially sensitized tabular grain photographic emulsions containing stabilizing addenda that include a mercaptotetrazole and a tetraazaindene.

BACKGROUND OF THE INVENTION

The ability to discriminate between exposed and unexposed areas of photographic film or paper is the most basic requirement of any photographic recording device. In a normal sequence, the exposed photographic element is subjected to a chemical developer, wherein a very large amplification is effected through production of metallic silver as a result of catalytic action of small latent image centers that are believed to be small silver or silver and gold clusters. The resulting silver then forms the final image in many black and white products, or oxidized developer resulting from the silver reduction reaction can be reacted with couplers to form image dye. In either case, because of the thermodynamic driving force of the chemical developer to reduce silver halide to silver, it is not surprizing that achievement of the desired discrimination between exposed and unexposed regions of a photographic element continues to challenge photographic scientists: Any non-image catalytic center will facilitate the unwanted production of metallic silver and image dye in unexposed areas during the development process. These non-image catalytic centers can come from one or more of various sources. For example, they may be the result of an inadvertant reductive process that generates Ag centers, they may be silver sulfide or silver/gold sulfide centers that result from inadvertant oversensitization, or they may result from trace metals such as iron, lead, tin, copper, nickel, and the like from raw materials and/or manufacturing equipment. Whatever the cause, it is the most basic goal of photographic technology to provide excellent discrimination depending on exposure or lack of it.

There are three additional goals that are closely related to the one just stated. The first is to provide film and paper that have uniform response characteristics within and between manufacturing events. For this reason, it is essential that sensitized emulsions remain stable prior to being coated in product. A second goal is that sensitivity of coated product should remain relatively unchanged over a convenient shelf storage time interval, which is generally referred to as good raw stock stability. The third goal relates to stability of latent image, which must be high so that apparent sensitivity remains relatively unchanged from beginning to end of a particular roll of film, even when the exposure sequence is extended over several weeks. This invention is directed to all these goals, namely to achieving sharp discrimination between exposed and unexposed regions, excellent stability of sensitized emulsions (and corresponding high product uniformity), and excellent raw stock and latent image stability.

In recent years, the utility of tabular grain emulsions has become evident following disclosures of Kofron et al U.S. Pat. No. 4,439,520. An early cross-referenced variation on the teachings of Kofron et al was provided by Maskasky U.S. Pat. No. 4,434,501. Maskasky demonstrated significant increases in photographic sensitivity as a result of selected site sensitizations involving silver salt epitaxy. Still more recently, Antoniades et al U.S. Pat. No. 5,250,403 taught the use of ultrathin tabular grain emulsions in which the tabular grains have an equivalent circular diameter (ECD) of at least 0.7 μm and a mean thickness of less than 0.07 μm, and in which tabular grains account for greater than 97 percent of the total grain projected area. Coassigned patent applications now on file teach epitaxial sensitization of ultrathin tabular emulsions in which the host and epitaxy have preferred composition or dopant management (U.S. Ser. No. 08/296,562 filed Aug. 26, 1994, now U.S. Pat. No. 5,503,970; U.S. Ser. No. 08/297,195 filed Aug. 26, 1994, now U.S. Pat. No. 5,576,168; U.S. Ser. No. 08/297,430 filed Aug. 26, 1994, now U.S. Pat. No. 5,503,971; U.S. Ser. No. 08/359,251 filed Dec. 19, 1994, now U.S. Pat. No. 5,494,789; U.S. Ser. No. 08/363,477 filed Dec. 23, 1994, now U.S. Pat. No. 5,631,126; U.S. Ser. No. 08/363,480 filed Dec. 23, 1994, now U.S. Pat. No. 5,629,144; U.S. Ser. No. 08/441,132 filed May 15, 1995, now U.S. Pat. No. 5,536,632; U.S. Ser. No. 08/441,488 filed May 15, 1995, U.S. Ser. No. 08/441,489 filed May 15, 1995, now U.S. Pat. No. 5,614,358; U.S. Ser. No. 08/441,491 filed May 15, 1995, now U.S. Pat. No. 5,573,902; U.S. Ser. No. 08/442,228 filed May 15, 1995, now U.S. Pat. No. 5,576,171; and U.S. Ser. No. 08/451,881 filed May 26, 1995).

Epitaxially sensitized emulsions in general, and epitaxially sensitized ultrathin tabular emulsions in particular, present some unique challenges in selection of antifoggants and stabilizers. This is due to the presence of at least two different silver salt compositions in the same emulsion grains. Thus, in the case of Ag(Br,I) hosts that have AgCl-containing epitaxy deposited on them, it is not immediately evident whether addenda should be selected that are appropriate to the Ag(Br,I) host or to the AgCl-containing epitaxy. It is further complicated by the fact that the host and epitaxy will likely have different exposed crystal lattice planes, and what adsorbs to host planes may not adsorb to those of the epitaxy, or an addendum that stablizes one surface may destabilize the other. Moreover, there is a strong entropic driving force for the Ag(Br, I) host and AgCl regions to recrystallize to form a single uniform composition (C. R. Berry in The Theory of the Photographic Process, 4th Ed., T. H. James, Ed., New York: Macmillan Publishing Co., Inc., (1977), p 94f). Finally, if the Ag(Br,I) host is ultrathin, there is the additional strong tendency for Ostwald ripening to occur due to the high surface energy resulting from their large surface area/volume ratio (C. R. Berry, loc cit, p 93). For these reasons, choice of antifogging addenda for epitaxially sensitized ultrathin tabular grain emulsions is not at all obvious.

Maskasky, J. E., U.S. Pat. No. 4,435,501, columns 35 and 36, provides an extensive list of stabilizers and antifoggants for epitaxially sensitized emulsions, drawn from prior disclosures of such addenda on nonepitaxially sensitized emulsions, but no specific data to illustrate their effectiveness. Many of the materials suggested by Maskasky are somewhat ineffective. Corben, L. D., U.S. Pat. No. 4,332,888, and Himmelwright et al, U.S. Pat. No. 4,888,273 describe emulsion stabilizers comprising 1-phenyl-5-mercaptotetrazole and a tri- tetra- or pentaazaindene, or a 1-phenyl-5-mercaptotetrazole with phenyl substitution and azaindene.

PROBLEM TO BE SOLVED BY THE INVENTION

It is important to note that while discrimination between exposed and nonexposed areas uniform product and raw stock and latent image stability are very basic requirements of a photographic film or paper, they are by no means the only ones. In particular, it is highly desirable to achieve the desired discrimination and stabilization without degradation of sensitivity or image structure.

There is a continuing need for methods of improving the speed/fog characteristics and raw stock stability characteristics of epitaxially sensitized ultrathin tabular grain emulsions.

SUMMARY OF THE INVENTION

The invention provides an emulsion comprising silver halide grains, said grains being tabular and comprising sensitizing dye(s) and silver salt epitaxial deposits, and addenda that include a mercaptotetrazole and a tetraazindene.

ADVANTAGEOUS EFFECT OF THE INVENTION

The invention provides an emulsion having increased photographic speed and decreased granularity with a stable emulsion with minimal fog.

DETAILED DESCRIPTION OF THE INVENTION

The invention has many advantages over prior sensitization for tabular emulsions. The invention finds particular use in ultrathin emulsions that have epitaxy. The combination of mercaptotetrazole and tetraazaindene, particularly in the preferred ranges, provides an emulsion that is stable with good raw stock keeping properties. Further, the grains have improved speed/fog characteristics, either decreased fog at a particular speed, increased speed at a given fog, or both increased speed and decreased fog. These advantages will be obvious from the description below.

The ultrathin grains of the invention having epitaxial areas may be formed by any technique. Particularly desirable for the invention are those grains as disclosed in U.S. Ser. No. 08/297,430 filed Aug. 26, 1994, now U.S. Pat. No. 5,503,971; U.S. Ser. No. 08/296,562 filed Aug. 26, 1994, now U.S. Pat. No. 5,503,970; U.S. Ser. No. 08/297,/195 filed Aug. 26, 1994, now U.S. Pat. No. 5,576,168; U.S. Ser. No. 08/359,251 filed Dec. 19, 1994, now U.S. Pat. No. 5,494,789; U.S. Ser. No. 08/363,477 filed Dec. 23, 1994, U.S. Ser. No. 08/441,132 filed May 15, 1995, now U.S. Pat. No. 5,536,632; U.S. Ser. No. 08/441,488 filed May 15, 1995, U.S. Ser. No. 08/441,489 filed May 15, 1995, U.S. Ser. No. 08/441,491 filed May 15, 1995, now U.S. Pat. No. 5,573,902; U.S. Ser. No. 08/442,228 filed May 15, 1995, now U.S. Pat. No. 5,576,171; and U.S. Ser. No. 08/451,881 filed May 26, 1995 which are coassigned and are hereby incorporated by reference. The preferred emulsions of the invention are a radiation-sensitive emulsion comprised of a dispersing medium, silver halide grains including tabular grains, said tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and forming the edges and corners of the tabular grains, and a spectral sensitizing dye adsorbed to at least the major faces of the tabular grains, wherein the surface chemical sensitization sites include at least one silver salt epitaxially located on and confined to the laterally displaced regions of said tabular grains.

Preferred emulsions have tabular grains that account for greater than 97 percent of the total grain projected area and may contain a photographically useful dopant that results in reduced reciprocity failure or increased photographic speed. The preferred emulsions of the invention are those wherein the central regions contain less than half the iodide concentration of the laterally displaced regions and at least a 1 mole percent lower iodide concentration than the laterally displaced regions. In preferred grains of the invention, the silver salt is predominantly located adjacent the edges of the tabular grain, and it is most preferred that it be located adjacent the corners of the tabular grains. The thin tabular grains may be comprised of silver chloride, silver bromoiodide, or silver bromide. The grains generally have a lower concentration level of iodide in the central regions than at the edges.

In one preferred embodiment the silver salt epitaxy (a) is of isomorphic face centered cubic crystal structure, (b) includes at least a 10 mol % higher chloride ion concentration than the tabular grains, and (c) includes an iodide concentration that is increased by iodide addition during the epitaxy formation step.

In another preferred embodiment the silver salt epitaxy contains a photographically useful metal ion dopant in which said metal ion displaces silver in the crystal lattice of the epitaxy, exhibits a positive valence of from 2 to 5, and has its highest energy electron occupied molecular orbital filled and its lowest energy unoccupied molecular orbital at an energy level higher than the lowest energy conduction band of the silver halide lattice forming the epitaxial protusions.

Any suitable mercaptotetrazole may be utilized in the invention. Typical of such mercaptotetrazoles are those having the following formula:

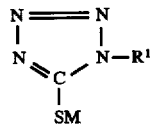

Formula III where M is a cation such as hydrogen, $NH_4$, sodium, or potassium, and $R^1$ is an aliphatic or aromatic radical containing up to 20 carbon atoms. Alkyl or aryl radicals comprising R may be unsubstituted or substituted. Suitable substituents include, for example, alkoxy, phenoxy, halogen, cyano, nitro, amino, substituted amino, sulfo, sulfamyl, substituted sulfamyl, sulfonylphenyl, sulfonyl-alkyl, fluorosulfonyl, sulfonamidophenyl, sulfonamido-alkyl, carboxy, carboxylate, ureido carbamyl, carbamyl-phenyl, carbamylalkyl, carbonylalkyl, and carbonylphenyl.

The following are examples of the compounds having Formula III, but the present invention is not limited by the examples. The Formula S-5 compound is the preferred mercaptotetrazole.

EXEMPLIFIED COMPOUNDS OF FORMULA III (S-1)

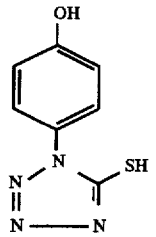

(S-2)

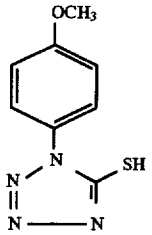

(S-3)

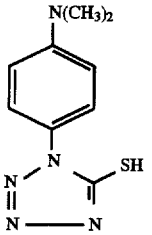

(S-4)

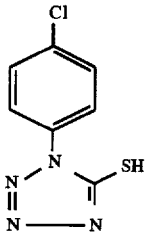

(S-5)

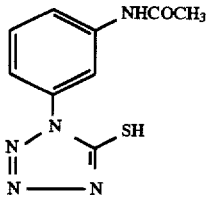

(S-6)

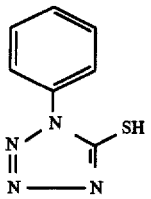

(S-7)

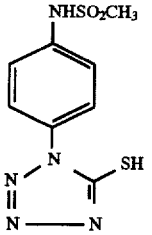

-continued (S-8)

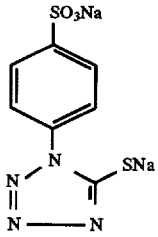

(S-9)

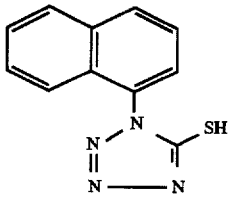

(S-10)

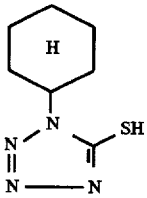

Further examples of mercapto compounds useful in the practice of this invention are 1(3-methoxy- phenyl)-5-mercaptotetrazole, 1-(3-ureidophenyl)-5-mercaptotetrazole, 1-((3-N-carboxymethyl)-ureidophenyl)-5-mercaptotetrazole, 1-((3-N-ethyl oxalamido)phenyl)-5-mercaptotetrazole, 1-(4-ureidophenyl)-5-mercapto-tetrazole, 1-(4-acetamidophenyl)-5-mercapto-tetrazole, and 1-(4-carboxyphenyl)-5-mercaptotetrazole.

Aside from the features of spectrally sensitized, silver salt epitaxy sensitized ultrathin tabular grain emulsions described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure*, Vol. 308, December 1989, Item 308119, Section I.

Any suitable tetraazaindene may be used in the method of the invention. Suitable for the invention are compounds of Formula I:

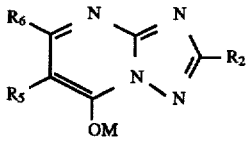

(I)

wherein $R_2$, $R_5$, and $R_6$ can independently be chosen from hydrogen, bromo, cyano, mercapto, carbon, alkyl or substituted alkyl including carboxy alkyl and thio alkyl, unsubstituted or substituted aryl, where alkyl and aryl groups have 12 or fewer carbon atoms and can optionally be linked through a divalent oxygen or surfur atom; and M is hydrogen, alkaline earth, or quaternized ammonium ion.

The preferred alkaline earths for M are sodium and potassium. Hydrogen is the most preferred M.

The preferred tetraazaindenes have a $pK_a$ of less than or equal to 6 and/or an anchor group suitably thioalkyl or mercapto. An anchor group enables a compound to absorb to silver halide surfaces more tightly than it would if a different compound was present.

Preferred tetraazaindenes are AF-13, AF-14, and

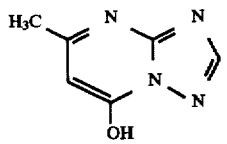

(TAI)

Other addenda that may be added with the mercaptotetrazole and tetraazaindene of the invention include organic dichalcogenides such as disulfides, chalcogenazoliums such as thiazoliums, and gold compounds of very low water solubility such as gold sulfide or palladium compound such as chloropalladate.

The organic dichalcogenides of the invention suitable may be represented by Formula IB.

$R^1—X^1—X^2—R^2$ (Formula IB)

In the above formula $X^1$ and $X^2$ are independently S, Se, or Te; and $R^1$ and $R^2$, together with $X^1$ and $X^2$, form a ring system, or are independently substituted or unsubstituted cyclic, acyclic or heterocyclic groups. Preferably the molecule is symmetrical and $R^1$ and $R^2$ are alkyl or aryl groups. Preferred is the combination of $R^1$ and $R^2$ resulting in a dichalcogenide with a molecular weight greater than 210 g/mol. $R^1$ and $R^2$ cannot be groups which cause the compound to become labile, such as for example,

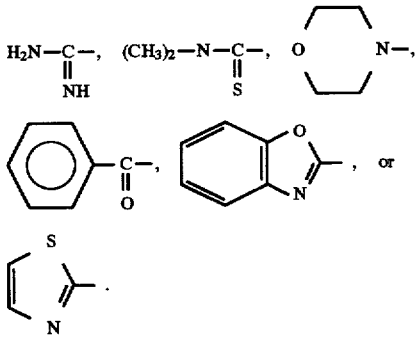

Some examples of preferred compounds are shown below.

$R^1-X^1-X^2-R^2$

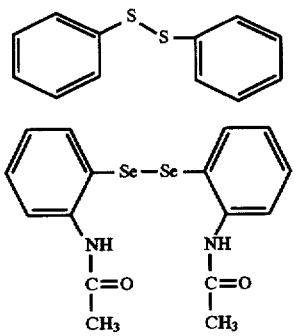

-continued

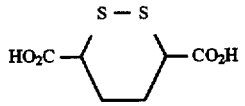

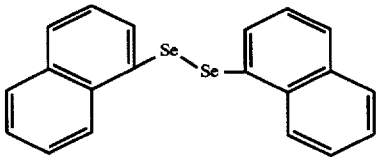

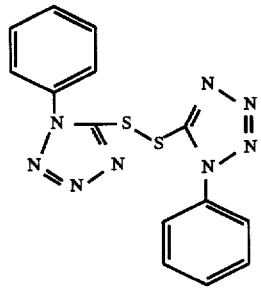

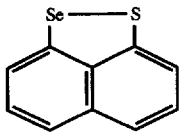

$HO_2C(CH_2)_4-Se-Se-(CH_2)_4CO_2H$

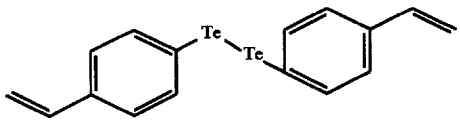

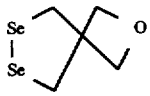

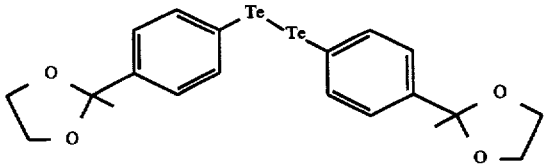

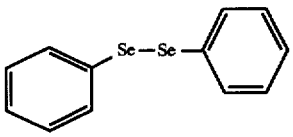

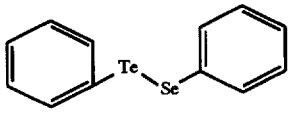

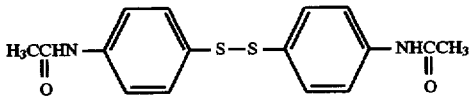

D-1

-continued

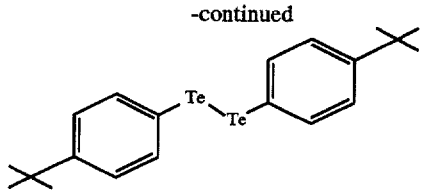

The dichalcogen must be non-labile meaning it does not release elemental chalcogen or chalcogen anion under specified conditions for making conventional photographic emulsions or the resulting photographic element. A preferred compound of the invention is D-1 above.

Any suitable chalcogenazolium represented by formula (IA) may be utilized.

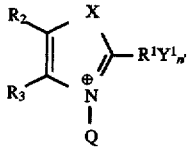

(IA)

$R^1$ is hydrogen, alkyl of from 1 to 8 carbon atoms, or aryl of from 6 to 10 carbon atoms;

$R^2$ and $R^3$ are independently hydrogen or halogen atoms, aliphatic or aromatic hydrocarbon moieties optionally linked through a divalent oxygen or sulfur atom; or cyano, amino, amido, sulfonamido, sulfamoyl, ureido, thioureido, hydroxy, —C(O)M, or —$S(SO)_2M$ groups, wherein M is chosen to complete an aldehyde, ketone, acid, ester, thioester, amide, or salt; or $R^2$ and $R^3$ together represent the atoms completing a fused ring;

Q represents a quaternizing substituent;

X is a middle chalcogen atom (S, Se, or Te);

$Y^1$ represents a charge balancing counter ion; and n is the integer 0 or 1.

In a preferred form $R^2$ and $R^3$ together form one or more fused carbocyclic aromatic rings, e.g., benzo or naphtho ring, either of which can be optionally substituted.

It has been recognized that ring hydrolysis of the chalcogenazolium compounds is important to their log inhibiting activity. This hydrolysis may be accomplished deliberately, or it may occur spontaneously when incorporated into silver halide emulsions of appropriate pH. When hydrolyzed, the compounds of formula (IA) can be represented by formula (II):

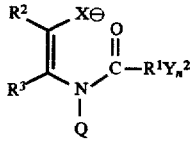

(II)

wherein $R^1$, $R^2$, $R^3$, Q, X, and n are as previously defined, and $Y^2$ is a change balancing counter ion.

An improved speed/fog relationship can be realized by modification of the quaternizing substituent of any quaternized chalcogenazolium salt of a middle chalcogen which is capable of undergoing hydrolysis in the manner indicated. Conventional quaternizing substituents are optionally substituted hydrocarbon substituents, sometimes including a carbon chain interrupting group, such as an oxy, carboxy, carbamoyl, or sulfonamido group. A preferred embodiment is the use of a quaternizing substituent having a divalent group satisfying formula (III)

$$-T\overset{H}{\leftarrow}N-T^1\rightarrow_m \quad \text{(IIIA)}$$

where:

T and $T^1$ are independently carbonyl (CO) or sulfonyl ($SO_2$) and m is an integer of from 1 to 3.

In a specific preferred form the quaternizing substituent, e.g., Q, can be alkyl, aryl, or can take the form represented by formula (IV):

$$-L-T\overset{H}{\leftarrow}N-T^1\rightarrow_m R \quad \text{(IV)}$$

wherein

T is carbonyl or sulfonyl;

$T^1$ is independently in each occurrence carbonyl or sulfonyl; and

L represents a divalent linking group, such as an optionally substituted divalent hydrocarbon group;

R represents an optionally substituted hydrocarbon residue or an amino group; and m is an integer of from 1 to 3.

In preferred embodiments of the invention T is carbonyl and $T^1$ is sulfonyl. However, either or both of T and $T^1$ can be either carbonyl or sulfonyl. Further, where m is greater than 1, $T^1$ can in each occurrence be carbonyl or sulfonyl independently of other occurrences.

L is preferably an alkylene (i.e., alkanediyl) group of from 1 to 8 carbon atoms. In specifically preferred forms of the invention L is either methylene (—$CH_2$—) or ethylene (—$CH_2CH_3$—).

R is preferably a primary or secondary amino group, an alkyl group of from 1 to 8 carbon atoms (e.g., methyl, ethyl, propyl, i-propyl, n-butyl, i-butyl, t-butyl, neopentyl, or n-octyl), or an aryl group of from 6 to 10 carbon atoms (e.g., phenyl or naphthyl). When R completes a secondary amine, it can be substituted with an optionally substituted hydrocarbon residue, preferably an alkyl group of from 1 to 8 carbon atoms or an aryl group of 6 to 10 carbon atoms, as above described. It is also recognized that R can be chosen, if desired, to complete a bis compound. For example, R can take a form similar to L, and the hydrolyzed chalcogenazolium ring linked to L, thereby incorporating a second hydrolyzed chalcogenazolium ring into the fog-inhibiting agent.

The most preferred compounds are AF-4 and AF-5 shown below.

The suitable palladium compounds are disclosed in the coassigned and copending U.S. Ser. No. 08/566,770 filed Dec. 4, 1995. A preferred palladium compound is Bis-(1,2-ethandiamine-N,N')palladium(2+)di-chloride.

The sparingly soluble gold compounds suitable for the invention are disclosed in U.S. Pat. No. 2,597,915. $Au_2S$ (AF-1) is the preferred sparingly soluble gold compound.

Emulsions of the invention find their preferred use in color negative films. The high sensitivity and fine grain allow the production of their desirable high speed fine grain imaging films.

It has been found that adding PHR (2,5-dihydroxy-5-methyl-3-(1-piperidinyl)-2-cyclopentane-1-one) to either the mid magenta or fast yellow dispersion melts of a color negative material incorporating thin tabular silver halide grains having epitaxial areas significantly reduced magenta density loss with latent image keeping. The amount of PHR utilized suitably is between 0.5 mg/$m^2$ and 50 mg/$m^2$. A preferred amount is between 1 mg/$m^2$ and 20 mg/$m^2$.

The optimal amount of each of the antifoggants depends on the desired final result, and emulsion variables such as composition of host and epitaxy, choice and level of sensitizing dye, and level and type of chemical sensitizers. Also it is understood that excess halide concentration (often expressed as pBr) and pH can be varied. Suitable concentrations are as follows:

for the mercaptotetrazole: 0.000001 to 0.10 moles/mole Ag with the preferred range being 0.00001 to 0.010 moles/mole Ag, for the tetraazaindene: 0.00001 to 1 mole/mole Ag with the preferred range being 0.0001 to 0.10 moles/mole Ag, for the organic dichalcogenide: 0.0000001 to 0.01 moles/mole Ag with the preferred range being 0.000001 to 0.001 moles/mole Ag, for the chalcogenazolium: 0.00001 to 0.5 mole/mole Ag with the preferred range being 0.0001 to 0.05 moles/mole Ag, for the sparingly soluble gold compound: 0.00000001 to 0.0001 moles/mole Ag with the preferred range being 0.0000001 to 0.00001 moles, and for the palladium compound: 0.0000001 to.0.01 moles/mole Ag, with the preferred range being 0.000001 to 0.001 moles/mole Ag.

The invention is illustrated with the following examples which distinguish the invention from prior art through demonstration of superior fresh speed, Dmin, and contrast responses, improved stability in accelerated raw stock aging tests, or differences in latent image stability:

EXAMPLES

Host Emulsion 1. Silver Bromoiodide Banded Iodide Composition: 3% I in the inner 75% and 12% I in the outer 25% of the grains.

A vessel equipped with a stirrer was charged with 9.375 L water containing 3.75 g phthalic anhydride-treated (10% phthalic anhydride) lime-processed bone gelatin, 6.44 g NaBr, an antifoamant, and sufficient sulfuric acid to adjust pH to 1.83, at 60° C. During nucleation, which was accomplished by balanced simultaneous 15 sec. addition of $AgNO_3$ and halide (99.25 and 0.75 mole-% NaBr and KI, respectively) solutions, both at 0.9M, in sufficient quantity to form 0.0225 moles of Ag(Br,I), pBr and pH remained approximately at the values initially set in the reactor solution. Following nucleation, the reactor gelatin was quickly oxidized by addition of 64 mg of Oxone ($2KHSO_5.KHSO_4.K_2SO_4$ purchased from Aldrich) in 50 $cm^3$ $H_2O$, and the temperature was held at 60° C. After the reactor and contents were held at this temperature for 12 min, 100 g of oxidized lime-processed bone gelatin dissolved in 0.5 L $H_2O$ at 60° C. was added to the reactor. Next the pH was raised to 5.85, and 14 min. after nucleation 54.0 $cm^3$ of 1M NaBr was added to the reactor at a rate of 100 cc/min. Fifteen minutes after nucleation, the growth stage was begun during which 3.6M $AgNO_3$, 3.8M NaBr, and a 0.141M suspension of AgI were added in proportions to maintain a uniform iodide level of 3.0 mole-% in the growing silver halide crystals. During this portion of growth, the reactor pBr was ramped downward (by appropriate excess flow of 3.8M NaBr relative to the 3.6M $AgNO_3$) from the initial value set by NaBr level in the reactor prior to nucleation and that added prior to start of growth: During the first 40 minutes it was lowered to 1.59, then over the remaining 50 minutes of growth of the 3.0 mole-% I portion, it was further lowered to 1.42. During this portion of growth, flow of 3.6M $AgNO_3$ was accelerated 7.66 fold. Next, growth of the outer portion, i.e., the last 25% of the emulsion having composition of 12% I, was begun. During this portion of the growth, flow of a more concentrated (0.623M) AgI suspension was begun while flow of 3.6M $AgNO_3$ and 3.8M NaBr was continued at reduced flow rates and with less rapid acceleration in order to avoid renucleation; during this last portion of the precipitation, flow rates were accelerated 1.25× while pBr was raised to 1.68 (by appropriately lower flow of NaBr relative to $AgNO_3$), and AgI flow was modulated to produce a composition of 12% I in the growing microcrystals. When addition of $AgNO_3$, NaBr, and AgI was complete, having formed a total of 7.37 moles of Ag(Br, I), the resulting emulsion was coagulation washed and pH and pBr were adjusted to storage values of 6 and 2.5, respectively.

The resulting emulsion was examined by scanning electron micrography (SEM) and mean grain area was determined using a Summagraphics SummaSketch Plus™ sizing tablet that was interfaced to an IBM™ Personal Computer: 95 number-% of the crystals were tabular and more than 97% of the projected area was provided by tabular crystals. The mean diameter was 1.16 μm (coefficient of variation= 48). Since this emulsion is almost exclusively tabular, the grain thickness was determined using a dye adsorption technique: The level of 1,1'-diethyl-2,2'-cyanine dye required for saturation coverage was determined, and the equation for surface area was solved for thickness assuming the solution extinction coefficient of this dye to be 77,300 L/mole cm and its site area per molecule to be 0.566 $nm^2$. This approach gave a thickness value of 0.057 μm.

Sensitized Emulsion 1: Epitaxial Sensitization of Host Emulsion 1:

A 0.5 mole sample of Host Emulsion 1 was liquified at 40° C. and its pBr was was adjusted to ca. 4 with simultaneous addition of $AgNO_3$ and KI solutions in a ratio such that the small amount of silver halide precipitated during this adjustment was 12% I. Next, 2 mole-% NaCl (based on the original amount of Ag(Br,I) host) was added, followed by addition of 447 mg Dye 1 and 774 mg Dye 2/mole Ag, after which 6 mole-% AgCl epitaxy was formed by a balanced double jet addition of $AgNO_3$ and NaCl solutions. This procedure produced epitaxial growths mainly on corners and edge locations of the host emulsion grains. Although predominantly of AgCl composition, some AgBr and even less AgI from the host is typically also incorporated into the epitaxy. The post-epitaxy components (levels are per mole of host emulsion) included 0.136 mg bis(2-amino-5-iodopyridinedihydroiodide) mercuric iodide, 75 mg Dye 1 and 132 mg Dye 2, 60 mg NaSCN, sulfur and gold sensitizers (3.7 mg 1,3-dicarboxymethyl-1,3-dimethyl-2-thiourea disodium salt, and 2.2 mg bis(1,4,5-trimethyl-1,2,4-triazolium-3-thiolate) gold(1) tetrafluoroborate), and 6.4 mg 3-methyl-1,3-benzothiazolium iodide. After all components were added the mixture was heated to 50° C. for 5 minutes in order to complete the sensitization. The resulting sensitized emulsion was coated by a dual melt procedure on cellulose acetate support over a gray silver antihalation layer, and the emulsion layer was overcoated with a 2.15 $g/m^2$ gelatin layer that also contained surfactant and BVSM hardener (1.75 wt % based on total gelatin). Addenda of interest were added to respective Ag melts (containing ca. 0.05 mole of sensitized emulsion) before coating. Emulsion laydown was 0.646 g $Ag/m^2$ and its layer also contained 0.323 $g/m^2$ and 0.019 $g/m^2$ of Couplers 1 and 2, respectively that were added in a melt separate from the Ag, and this coupler melt also contained 10.5 $mg/m^2$ of 4-hydroxy-6-methyl-1,3,3A,7-tetraazaindene ($Na^+$ salt) and 14.4 mg/m2 2-(2-octadecyl)-5-sulfohydroquinone ($Na^+$ salt). Gelatin laydown in the emulsion layer was 1.08 g/m$^2$. The emulsions so coated were exposed and processed within a few days of coating (fresh responses) and again after accelerated raw stock stability tests. Exposures were of 0.01" duration using Wratten 23A filtered daylight balanced light that passed through a calibrated neutral step tablet, and development was accomplished using the Kodak Flexicolor™ C41 process. The optical densities of the resulting dye scales were plotted as a function of log(exposure), with the speed point being taken as that exposure which was required to produce a density of 0.15 units above $D_{min}$. Speed values were determined by the equation S=−100(logE), where E is the exposure relative to the clear (least dense) step, and where E for the clear step is taken as 1. Thus a speed of 100 would indicate that the 0.15 density was achieved with 1/10 as great an exposure as at the clear step, 200 corresponds to 1/100 as much exposure, etc. Speed changes that occurred as a result of raw stock stability tests cited in tables below use the same metrics: a delta speed of −30, for example indicates a 0.30 log E speed loss, which corresponds to ca. halving the sensitivity.

Host Emulsion 2: Silver Bromoiodide Banded-I Composition: 1.5 Mole-% I in the inner 75%/12 Mole-% in the outer 25% of the grains:

A vessel equipped with a stirrer was charged with 5.89 L of water containing 3.75 g lime-processed bone gelatin, 4.12 g NaBr, an antifoamant, and sufficient sulfuric acid to adjust pH to 1.8, at 39° C. During nucleation, which was accomplished by balanced simultaneous 4 sec. addition of $AgNO_3$ and halide (98.5 and 1.5 mole-% NaBr and KI, respectively) solutions, both at 2.5M, in sufficient quantity to form 0.01335 moles of AG(Br, I), pBr and pH remained approximately at the values initially set in the reactor solution. Following nucleation, the reactor gelatin was quickly oxidized by addition of 128 mg of Oxone ($2KHSO_5.KHSO_4.K_2SO_4$ purchased from Aldrich) in 20 cm$^3$ $H_2O$, and the temperature was raised to 54° C. in 9 min. After the reactor and contents were held at this temperature for 9 min, 100 g of oxidized lime-processed bone gelatin dissolved in 1.5 L $H_2O$ at 54° C. was added to the reactor. Next the pH was raised to 5.90, and 122.5 cm$^3$ of 1M NaBr was added to the reactor. Twenty four and a half minutes after nucleation, the growth stage was begun during which 2.5M $AGNO_3$, 2.8 M NaBr, and a 0.0524M suspension of AGI were added in proportions to maintain a uniform iodide level of 1.5 mole-% in the growing silver halide crystals, and the reactor pBr at the value resulting from the cited NaBr additions prior to start of nucleation and growth. This pBr was maintained until 0.825 moles of Ag(Br,I) had formed (constant flow rates for 40 min), at which time the excess $Br^-$ concentration was increased by addition of 105 cm$^3$ of 1M NaBr; the reactor pBr was maintained at the resulting value for the balance of the growth. Flow rate of $AgNO_3$ was accelerated so that the flow rate at the end of this 53.2 min. segment was 10× that at the beginning. After about 6.75 moles of emulsion had formed (1.5 mole-% I), the ratio of flows of of AgI to $AgNO_3$ was changed such that the remaining portion of the 9 mole batch was 12 mole-% I. During formation of this high iodide band, flow rate at the start of this segment, based on rate of total AG delivered to the reactor, was approximately 25% as great as at the end of the previous segment, and it was accelerated such that end of flow rate was 1.6 times that at the beginning of this segment. When addition of $AGNO_3$, AgI, and NaBr was complete, the resulting emulsion was coagulation washed and pH and pBr were adjusted to storage values of 6 and 2.5, respectively.

The resulting emulsion was characterized by the methods described for Host Emulsion 1. Its mean diameter was 1.75 μm (COV=42), and its grain thickness was 0.063 μm.

Sensitized Emulsion 2: Sensitization of Host Emulsion 2.

In this description, all levels are relative to 1 mole of host emulsion. A 5 mole sample of Host Emulsion 2 was liquified at 40° C. and its pBr was adjusted to ca. 4 with a simultaneous addition of $AgNO_3$ and KI solutions in a ratio such that the small amount of silver halide precipitated during this adjustment was 12% I. Next, 2 mole-% NaCl (based on the original amount of Ag(Br, I) host) was added, followed by addition of sensitizing dyes (901.7 mg of Dye 3 and 311.3 mg of Dye 4), after which 6 mole-% Ag(Cl,Br,I) epitaxy was formed by the following sequence of additions: 2.52% $Cl^-$ added as a $CaCl_2$ solution, 0.000030 moles $K_4Ru(CN)_6$ in a dilute water solution, 2.52% $Br^-$ added as a NaBr solution, 0.96% $I^-$ added as a AgI suspension, and 5.04% $AgNO_3$. The post-epitaxy components included 0.75 mg 4,4'-phenyl disulfide diacetanilide, 60 mg NaSCN, 2.52 mg 1,3-dicarboxymethyl-1,3-dimethyl-2-thiourea (disodium salt) as sulfur sensitizer, 0.95 mg bis(1,4,5-trimethyl-1,2,4-triazolium-3-thiolate) gold(1) tetrafluoroborate as gold sensitizer, and 3.99 mg 3-methyl-1,3-benzothiazolium iodide. After all components were added, the mixture was heated to 50° C. for 15 min. to complete the sensitization, then the sensitized emulsion was chilled and placed in a refrigerator until samples were taken for coatings. Coatings were on cellulose acetate support over a 4.89 g gelatin/m$^2$ sub layer that had REM JET antihalation on the back side. The emulsion layer was overcoated with a 4.3 g/m$^2$ gelatin layer, which also contained surfactant and BVSM hardener (1.75 weight-%, based on total gelatin). Emulsion coats were made using a dual melt technique in which the Ag melt contained the candidate stabilizing addenda and sufficient amounts of Sensitized Emulsion 2 to give a Ag laydown of 0.538 g Ag/m$^2$. The coupler melt contained sufficient amounts of Couplers 3 and 4 to give laydowns of at 0.323 and 0.016 g/m$^2$, respectively, and the two melts had sufficient gelatin to give a total of 1.08 g/m$^2$, and surfactant. Resulting coatings were exposed and processed within a few days (fresh tests) or after accelerated raw stock shelf life treatments (raw stock stability tests). Exposures were of 0.01 sec. duration using daylight balanced light that passed through a Wratten 9 filter and a 21 step granularity step tablet (0–4 density range), and development was accomplished using the Kodak Flexicolor™ C41 process. Speed metrics were as described for Sensitized Emulsion 1.

Host Emulsion 3: Silver Bromoiodide Banded-I Composition: 1.5 Mole-% I in the inner 75%/12 Mole-% in the outer 25% of the grains:

This emulsion was precipitated like Host Emulsion 2, except prior to growth 0.234 mole of NaCl was added to the reactor. Grain size and thickness were similar to that noted for Host Emulsion 2.

Sensitized Emulsion 3:

Host Emulsion 3 was sensitized and evaluated exactly as described for Sensitized Emulsion 2.

Host Emulsion 4: Silver Bromoiodide Banded-I Composition: 4.125 Mole-% I in the inner 75%12 Mole-% in the outer 25% of the grains:

A vessel equipped with a stirrer was charged with 6.62 L of water containing 4.21 g lime-processed bone gelatin, 4.63 g NaBr, an antifoamant, and sufficient sulfuric acid to adjust pH to 1.77 at 39° C. During nucleation, which was accomplished by balanced simultaneous 4 sec. addition of $AgNO_3$ and halide (98.5 and 1.5 mole-% NaBr and KI, respectively) solutions, both at 2.4M, in sufficient quantity to form 0.0150 moles of Ag(Br, I), pBr and pH remained approximately at the values initially set in the reactor solution. Following nucleation, the reactor gelatin was quickly oxidized by addition of 50 $cm^3$ of a 0.07 % NaOCl solution, and the temperature was raised to 54° C. in 9 min. After the reactor and contents were held at this temperature for 6 min, 100 g of oxidized lime-processed bone gelatin dissolved in a 1.5 L $H_2O$ solution, that also contained 0.165 moles NaOH and was at a temperature of 54° C., was added to the reactor, after which the reactor pH was fine-adjusted to 5.85. Next, 20.4 min after nucleation, 333.6 $cm^3$ of 1M halide solution (33% NaBr and 67% NaCl) was added to the reactor. Twenty one and four tenths minutes after nucleation, the growth stage was begun during which 3.0M $AgNO_3$, 3.33 M NaBr, and a 0.181M suspension of AgI were added in proportions to maintain an iodide level of 4.125 mole-% in the growing silver halide crystals, and the reactor pBr at the value resulting from the cited halide additions prior to start of nucleation and growth. This pBr was maintained until 0.635 moles of Ag(Br,I) had formed, at which time the excess $Br^-$ concentration was increased by addition of 147.4 $cm^3$ of a 1.5M NaBr solution; the reactor pBr was maintained at the resulting value for the balance of the growth. Flows of $AgNO_3$, NaBr, and AgI were continued until 6.75 moles of $AgBr_{0.95875}I_{0.04125}$ had formed in the reactor (105.6 min, accelerated flow so that end flow rate of $AgNO_3$ was 9.6× that at the start). In the final growth segment, flow of $AgNO_3$, AgI, and NaBr was continued, but with a more concentrated (0.527M) suspension of AgI, and with reduced flow rate of 3.0M $AgNO_3$ (0.49× as great as at the end of 4.125% I growth). During this segment, $AgNO_3$ flow rate was held constant, and relative flow rates of $AgNO_3$, AgI, and NaBr were modulated so as to maintain the pBr that prevailed at the end of previous segment, and so as to achieve 12% I in this final 2.25 mole portion. After the final growth segment was completed, the emulsion was then cooled to 40° C., and it was coagulation washed. Finally, pH and pBr were adjusted to storage values of 6 and 2.5, respectively.

Grains of the resulting emulsion were sized by standard techniques and the equivalent circular diameter of the mean area was found to be 1.79 um. Grain thickness was determined by dye adsorption to be 0.056 um.

Sensitized Emulsion 4

The sensitizing and evaluation procedure of Host Emulsion 4 was like that described for Sensitized Emulsion 2 except that levels were as follows: 973.6 mg of Dye 3, 336.0 mg of Dye 4, 0.000060 mole $K_4Ru(CN)$ 6, 2.65 mg 1,3-dicarboxymethyl-1,3-dimethyl-2-thiourea (disodium salt) as sulfur sensitizer, and 0.90 mg bis(1,4,5-trimethyl-1,2,4-triazolium-3-thiolate) gold(1) tetrafluoroborate as gold sensitizer, (levels stated are per mole of host emulsion).

Host Emulsion 5: Uniform $AgBr_{0.9875}I_{0.04125}$:

A vessel equipped with a stirrer was charged with 6 L of water containing 3.75 g lime-processed bone gelatin, 4.12 g NaBr, an antifoamant, and sufficient sulfuric acid to adjust pH to 1.9,at 39° C. During nucleation, which was accomplished by balanced simultaneous addition of $AgNO_3$ and halide (98.5 and 1.5 mole-% NaBr and KI, respectively) solutions, both at 2.5M, in sufficient quantity to form 0.01335 moles of Ag(Br,I), pBr and pH remained approximately at the values initially set in the reactor solution. Following nucleation, the reactor gelatin was quickly oxidized by addition of 128 mg of Oxone ($2KHSO_5.KHSO_4.K_2SO_4$, purchased from Aldrich), and the temperature was raised to 54° C. in 9 min and after the reactor and contents were held at this temperature for 9 min, 100 g of oxidized lime-processed bone gelatin dissolved in 1.5 L $H_2O$ at 54° C. was added to the reactor. Next the pH was raised to 5.86, and 43.75 $cm^3$ of 2.8M NaBr was added to the reactor. Twenty five minutes after nucleation was started, the growth stage was begun during which 2.5M $AgNO_3$, 2.8M NaBr, and a 0.108M suspension of AgI were added in proportions to maintain a uniform iodide level of 4.125% in the growing silver halide crystals, and the reactor pBr at the value resulting from the cited NaBr additions prior to start of nucleation and growth, until 0.848 moles of Ag(Br,I) had formed at which time the excess $Br^-$ concentration was increased by addition of 37.5 $cm^3$ of 2.8 M NaBr; the reactor pBr was maintained at the resulting value for the balance of the growth. Flow rate of $AgNO_3$ was accelerated approximately 13 fold during growth during which a total of 9 moles of Ag(Br, I) (4.125 %I) was formed. When addition of $AgNO_3$, AgI, and NaBr was complete, the resulting emulsion was coagulation washed and pH and pBr were adjusted to storage values of 6 and 2.5, respectively.

The resulting emulsion was examined by the same techniques as described for Host Emulsion 1: More than 99.5 % of the projected area was provided by tabular crystals, and the mean grain diameter was 1.89 μm (coefficient of variation=34). Grain thickness was determined to be 0.053 μm.

Epitaxial and nonepitaxial sensitizations of Host Emulsion 5:

Sensitized Emulsion 5A:

The epitaxial sensitization procedures used here were as described for Sensitized Emulsion 1, except that bis(2-amino-5-iodopyridine-dihydroiodide) mercuric iodide was omitted, $Na_2S_2O_3.5H_2O$ (sulfur), $KAuCl_4$ (gold) were used in place of 1,3-dicarboxymethyl-1,3-dimethyl-2-thiourea disodium salt, and 2.2 mg bis(1,4,5-trimethyl-1,2,4-triazolium-3-thiolate) gold(1) tetrafluoroborate), Dye 5 replaced Dye 1, 1-(3-acetamidophenyl)-5-mercaptotetrazole (APMT) was used as finish modifier in place of 3-methyl-1,3-benzothiazolium iodide, and the sensitization was carried out at 60° C. This sensitization employed 336 mg of Dye 5, 1370 mg of Dye 2, 2.83 mg $Na_2S_2O_3.5H_2O$ (sulfur), 0.99 mg $KAuCl_4$, and 11.35 mg APMT per mole of host emulsion.

Sensitized Emulsion 5B (non epitaxial sensitization):

This sensitization procedure was similar to that described for epitaxial sensitizations, except that the epitaxial deposition step was omitted. Thus after adjusting the initial pBr to ca. 4, Dye 5 and Dye 2 were added, then NaSCN, sulfur, gold and APMT were added as before, and this was followed by 60° C. heat treatment to complete the sensitization. Dye and APMT levels were the same as in Sensitized Emulsion 5A; 5.0 mg $Na_2S_2O_3.5H_2O$ (sulfur), and 1.39 mg $KAuCl_4$, were employed.

Sensitized Emulsions 5A and 5B were coated and evaluated similarly to that described for Sensitized Emulsion 1, but with no further stabilizing addenda or APMT and TAI (AF-14 and AF-11, respectively) added to the Ag melt.

Latent Image Stability Tests of Emulsion 5A and 5B

Coatings of Sensitized Emulsions 5A and 5B were tested for latent image keeping in the following manner: Two sets of results were compared. In the check case, strips of particular coatings were simply stored at conditions of 100° F. and 50% relative humidity for two weeks, then exposed and developed through the Kodak Flexicolor™ C41 process; this treatment is referred to as 2 wk 100° F./50%. The second identical group of strips was first stored at 100° F. and 50% relative humidity for one week, then exposed, and then stored at the same conditions for a second week before developing; this treatment is referred to as 1 wk 100° F./50%+1 wk LIK. Speed differences between the the check and exposed then held strips are referred to LIK changes: Responses from the exposed, then held strips that were slower or faster than the check are referred to as a LIK losses or gains, respectively.

Description of Accelerated Raw Stock Stability Tests

Each test involved two strips of the same coating, which represented check and test conditions. The test condition involved storage at higher temperature, which in all cases was 120° F., and at 50% relative humidity, for a period of 1 week. This treatment is referred to as 1 wk 120° F./50%. The check condition was also for 1 week and 50% relative humidity, but at lower temperature, either 78 or 0° F. This treatment is referred to as 1 wk 78° F./50% or 1 wk 0° F./50%. At the end of these storage times, both strips in each pair were identically exposed and processed as described for Sensitized Emulsions 1 or 2, depending on whether the emulsion was red or green sensitive, and speed, Dmin, and contrast of each strip was determined. Speed and Dmin values of the check strip were subtracted from corresponding values recorded from the strip that was given the high temperature treatment. These differences are called Delta Dmin and Delta 0.15 Speed in Tables below. Contrast is reported as percent loss and was gotten by subtracting the check value from that of the test, and then dividing by the check value and multiplying the result by 100.

Comparisons of Stabilizing Addenda

Various compounds, many of which were among general types listed in Maskasky, J. E., U.S. Pat. No. 4,435,501, columns 35 and 36, and which were known to stabilize nonepitaxial emulsions, were tested for their effectiveness in stabilizing Sensitized Emulsion 2. Results are listed in Table 1.

TABLE 1

Effects of Various Addenda on Sensitized Emulsion 2

| | | | | | | Raw Stock Stability 1 wk 120 F./50% vs 1 wk 78 F./50 | | |
|---|---|---|---|---|---|---|---|---|
| | Ag Melt | Level | Fresh Responses | | | Delta | Delta | % Cntrst. |
| Example | Addendum | (mg/mole) | Dmin | 0.15 spd | Contrast | Dmin | .15 spd | loss |
| 1 (Comp) | AF-1 | 0.252 | 0.17 | 255 | 0.65 | +0.60 | −192 | 56 |
| 2 (Comp) | AF-1 | 1.01 | 0.14 | 247 | 0.59 | +0.63 | −190 | 64 |
| 3 (Comp) | None | — | 0.16 | 256 | 0.70 | +0.58 | −172 | 52 |
| 4 (Comp) | AF-2 | 12.50 | 0.17 | 245 | 0.55 | +0.63 | −172 | 46 |
| 5 (Comp) | AF-3 | 664 | 0.17 | 246 | 0.60 | +0.58 | −151 | 56 |
| 6 (Comp) | AF-4 | 200 | 0.13 | 253 | 0.70 | +0.57 | −151 | 52 |
| 7 (Comp) | AF-5 | 100 | 0.13 | 257 | 0.73 | +0.56 | −150 | 54 |
| 8 (Comp) | AF-6 | 6 | 0.13 | 252 | 0.68 | +0.56 | −146 | 56 |
| 9 (Comp) | AF-7 | 54.4 | 0.13 | 243 | 0.64 | +0.60 | −144 | 35 |
| 10 (Comp) | AF-8 | 515 | 0.14 | 249 | 0.63 | +0.55 | −135 | 51 |
| 11 (Comp) | AF-9 | 60 | 0.131 | 250 | 0.79 | +0.55 | −129 | 43 |
| 12 (Comp) | AF-10 | 600 | 0.19 | 244 | 0.67 | +0.44 | −117 | 41 |
| 13 (Comp) | AF-11 + AF-12 | 1750 + 2400 | 0.15 | 256 | 0.67 | +0.38 | −72 | 57 |
| 14 (Comp) | AF-13 | 1453 | 0.13 | 262 | 0.68 | +0.31 | −40 | 44 |
| 15 (Comp) | AF-14 | 171.5 | 0.07 | 254 | 0.68 | +0.14 | −18 | 27 |
| 16 (Comp) | AF-15 | 622.5 | 0.13 | 261 | 0.69 | +0.16 | −19 | 31 |

Examples 1–16 demonstrate that many of the addenda that are known to stabilize nonepitaxial emulsions do not work well with the present epitaxially sensitized ultrathin tabular grain. Note that in Examples 1–12 speed losses from a 1 week incubation at 120° F. and 50% RH all exceeded 100 speed units, which indicates more than a 10 fold loss in sensitivity. In view of such large speed losses, the corresponding addenda are judged ineffective stabilizers. Only in Examples 13–18 were speed losses less than 100, and it is apparent that the order of effectiveness is AF-11+AF-12 (TAI+2-(2-octadecyl)-5-sulfohydroquinone ($Na^+$ salt))<AF-13 (Br-TAI)<AF-14 (APMT)<AF-15 (SMeTAI). Even in the best of these single addendum examples, speed losses are sizable, and more complete stabilization is strongly desired.

Comparison of the effectiveness of various TAIs in Examples 14, 15, and 17 is not completely straightforward because of the presence of 2-(2-octadecyl)-5-sulfohydroquinone ($Na^+$ salt) in Example 14.and not in the others. Examples 17–19 in Table 2 demonstrate that the relative effectiveness remains the same when this hydroquinone is present in all cases.

TABLE 2

Comparison of Various TAIs as Addenda to Sensitized Emulsion 1

| Example | Addendum | Level in Ag Melt (mg/mole) | Fresh Responses Dmin | Fresh Responses 0.15 spd | Fresh Responses Contrast | Raw Stock Stability 1 wk 120 F/50% vs. 1 wk 0 F/50 Delta Dmin | Delta .15 spd | % Cntrst loss |
|---|---|---|---|---|---|---|---|---|
| 17(Comp) | AF-11: TAI | 600 | 0.24 | 247 | 1.08 | 0.40 | −29 | 48 |
| 18(Comp) | AF-13: Br—TAI | 500 | 0.22 | 250 | 1.14 | 0.31 | −13 | 48 |
| 19(Comp) | AF-15: SMe—TAI | 500 | 0.20 | 255 | 1.13 | 0.28 | −9 | 35 |

Similar comparisons of AF-11, AF-13, and AF-15 were also made without the hydroquinone, but with each of the mercaptotetrazole compounds AF-14, AF-16, or AF-17 also present as an addendum. In all three of these additional cases, relative effectiveness of the three TAI compounds was found to be similar to that shown in Table 2. It is believed that the greater effectiveness of BrTAI relative to TAI is due to its decreased pKa (ca. 4.7 compared to ca. 6.3 for TAI). The greater effectiveness of SMeTAI relative to TAI is believed due to its greater affinity for the silver halide surface due to the presence of the thioether, which can be considered an "anchor group".

Further Illustration of Different Effect of Stabilizing Addenda on Epitaxially vs. Nonepitaxially Sensitized Emulsions: (Delta speeds are averages of observations in the two sets.)

Results presented in Table 1 demonstrate that many compounds that are capable of stabilizing nonepitaxially sensitized emulsions are quite ineffective when used in epitaxially sensitized emulsions. Results in Table 3 further illustrate this point by demonstrating very different LIK behavior when the invention addenda combination, namely a phenyl mercaptotetrazole and a tetraazaindene, are applied to the two types of sensitization. Note that the nonepitaxially sensitized emulsion, Sensitized Emulsion 5B, shows large LIK loss in both the absence and presence of APMT and TAI. The epitaxially sensitized emulsion, Sensitized Emulsion 5A, on the other hand, has very small LIK loss in the absence of APMT and TAI, but a small gain in their presence. Note especially that Sensitized Emulsion 5B (no epitaxy) with APMT and TAI shows LIK loss whereas Sensitized Emulsion 5A (epitaxy) with these addenda shows LIK gain. It is differences like these that make the behavior of stabilizing addenda for epitaxially sensitized thin tabular grain emulsions so unobvious.

As noted in connection with Table 1, further stabilization beyond that seen even with the most effective singly applied addendum, is highly desirable. However, it is not at all obvious that a combination of addenda would have an additive effect, because all available adsorption sites on the epitaxially sensitized ultrathin tabular emulsions grains might be expected to be completely covered by one or the other of the addenda. However, results obtained with Sensitized Emulsion 4 given in Table 4 demonstrate, surprisingly, that additive effects are in fact observed. Note that the combination of APMT and either TAI resulted in improved fresh Dmin and/or speed and decreased Dmin gain, and less speed and contrast loss in the raw stock keeping test than seen with APMT alone.

TABLE 3

Effect of APMT and TAI on LIK Behavior of Epitaxially and Nonepitaxially Sensitized Emulsions

| Example | Sensitized Emulsion | AF-14 (APMT) (mg/M Ag) | AF-11 (TAI) (mg/M Ag) | LIK Stability (1 wk 100 F/50% + 1 wk LIK) vs. (2 wk 100 F/50%) Delta .15 speed |
|---|---|---|---|---|
| 20(comp) | 5B(no Eptxy) | — | — | −9 |
| 21(comp) | 5B(no Eptxy) | 114.4 | 546 | −7 |
| 22(comp) | 5A(Eptxy) | — | — | −1 |
| 23(inv) | 5A(Eptxy) | 114.4 | 546 | +3 |

The Effect of Combining APMT and TAIs as Stabilizing Addenda (Epitaxially Sensitized Emulsion):

TABLE 4

Effect of Adding APMT and TAIs to (Epitaxially) Sensitized Emulsion 4

| Example | AF-14: APMT (mg/M Ag)) | AF-13: Br—TAI (mg/M Ag)) | AF45: SMeTAI (mg/M Ag)) | Fresh Responses Dmin | 0.15 Spd | Cntrst | Raw Stock Stability 1 wk 120 F/50% vs 1 wk 78 F/50% Delta Dmin | Delta .15 Spd | % Cntrst loss |
|---|---|---|---|---|---|---|---|---|---|
| 24(Comp) | — | — | — | 0.14 | 259 | 0.81 | +0.39 | −64 | 52 |
| 25(Comp) | 57.2 | — | — | 0.08 | 258 | 0.81 | +0.25 | −26 | 41 |
| 26(Inv) | 57.2 | 1215 | — | 0.08 | 261 | 0.81 | +0.19 | −12 | 37 |
| 27(Inv) | 57.2 | — | 640 | 0.08 | 259 | 0.79 | +0.12 | −10 | 27 |

Comparison of Various Phenyl Mercaptotetrazole (PMT) Compounds in Combination with Br-TAI:

These comparisons were made using Sensitized Emulsion 3, and they demonstrate the superiority of APMT (AF-14) over AF-16, which is the PMT compound taught by Corben, L. D., U.S. Pat. No. 4,332,888, and over AF-17, which is one of the preferred PMT compounds taught by Himmelwright, R. S., et al. U.S. Pat. No. 4,888,273. Note in Example 28 of Table 5 that APMT gave significantly higher fresh speed and lower Dmin than shown in Examples 29 and 30, which involved the prior art alternative PMT compounds.

TABLE 5

Comparison of Various PMT Compounds When Added to Sensitized Emulsion 3 in the Presence of BR—TAI

| Example | AF-14: APMT (mg/M Ag) | AF-16: (mg/M Ag) | AF-17: (mg/M Ag) | AF-13: Br-TAI (mg/M Ag) | Fresh Responses Dmin | 0.15 Spd | Cntrst |
|---|---|---|---|---|---|---|---|
| 28(Inv) | 114.4 | — | — | 726 | 0.06 | 239 | 0.67 |
| 29(Inv) | — | 86.7 | — | 726 | 0.09 | 229 | 0.64 |
| 30(Inv) | — | — | 94.4 | 726 | 0.07 | 231 | 0.64 |

Tests reported in Table 5 were also done with the same PMT compounds (AF-14, AF-16, and AF-17) both without a TAI and with SMeTAI (AF-15), and trends similar to those in Table 5 were observed.

Remaining examples examine combinations of APMT and SMeTAI with certain addenda reported in Table 1 to have very little, if any, stabilization effect when tested as the sole addendum. The first of these involves AF-6, a disulfide compound, and its effect when combined with APMT and SMeTAI.

Combination of a Disulfide with APMT and SMeTAI; Addenda were added to Sensitized Emulsion 2.

Levels of APMT and SMeTAI were 114.4 and 622.5 mg/mole Ag, respectively. Note that the presence of this disulfide led to less Dmin gain and to less speed and contrast loss in the raw stock stability test than seen in its absence. Judging from its effect as a single addendum (Example 9, Table 1), this advantage is quite unexpected.

TABLE 6

Combination of a Disulfide(AF-6) with APMT (AF-14) and SMeTAI (AF-15) Levels of AF-14 and AF-15: 114.4 and 622.5 mg/M Ag, respectively (Sensitized Emulsion 2).

| Example | AF-6 (mg/M Ag) | Fresh Responses Dmin | 0.15 Spd | Cntrst | Raw Stock Stability 1 wk 120 F/50% vs. 1 wk 78 F/50% Delta Dmin | Delta 15 Spd | % Cntrst loss |
|---|---|---|---|---|---|---|---|
| 31(Inv) | — | 0.08 | 258 | 0.68 | +0.17 | −17 | 34 |
| 32(Inv) | 6 | 0.08 | 257 | 0.68 | +0.15 | −11 | 30 |

Combination of a Benzothiazole with APMT, SMeTAI, and a Disulfide; Addenda were added to Sensitized Emulsion 2.

AF-4, a benzothiazole compound, was shown in Table 1 (Example 8) to be of little value as a single addendum. In Table 6 its effect is examined when combined with APMT, SMeTAI, and a disulfide compound at respective levels of 114.4, 622.5, and 6 mg/mole All Ag melts for coatings described in Table 7 also contained 515 mg NaBr/mole of sensitized emulsion. Note that AF-4 resulted in slightly less Dmin gain and less 0.15 speed loss in the raw stock stability test. Note also that the coating with AF-4 had higher fresh contrast which is desirable.

TABLE 7

Combination of a Thiazolium Compound (AF-4) with APMT (AF-14), SMeTAI (AF-15), and a Disulfide (AF-6)
Levels of AF-14, AF-15, and AF-6: 114.4, 622.5, and 6 mg/M Ag, respectively (Sensitized Emulsion 2)

| | | Fresh Responses | | | Raw Stock Stability 1 wk 120 F/50% vs. 1 wk 78 F/50% | | |
|---|---|---|---|---|---|---|---|
| Example | AF-6 (mg/M Ag) | Dmin | 0.15 Spd | Cntrst | Delta Dmin | Delta 15 Spd | % Cntrst loss |
| 33(Inv) | — | 0.08 | 257 | 0.68 | +0.10 | −4 | 18 |
| 34(Inv) | 200 | 0.06 | 255 | 0.73 | +0.09 | −3 | 19 |

Combination of $Au_2S$ with APMT, SMeTAI, a Disulfide, and Benzothiazole: addenda were added to Sensitized Emulsion 2.

As shown in Table 1, AF-1 actually caused significant destabilization of Sensitized Emulsion 2 in the raw stock stability test when added as a single addendum (increased speed loss corresponding to 18 or more units compared to the no addenda case (Examples 1 and 2 vs. Example 3)). For this reason, it was thought likely to be also not useful in combination with other addenda. Table 8 examines its effect in the presence of APMT, SMeTAI, AF-6, and AF-5, at respective levels of 114.4, 622.5, 6, and 200 mg/mole of sensitized emulsion. Ag melts for examples in Table 8 also contained 515 mg NaBr/mole sensitized emulsion. These results show, surprizingly, that in the accelerated raw stock stability test AF-1 ($Au_2S$) helped minimize contrast loss with only slightly (2 units) more speed loss.

TABLE 8

Combination of an Insoluble Gold Compound (AF-1) with APMT (AF-14), SMeTAI (AF-15), a Disulfide Compound (AF-6), and a Thiazolium Compound (AF-5)
Levels of AF-14, AF-15, AF-6, and AF-5: 114.4, 622.5, 6, and 200 mg/M Ag, respectively (Sensitized Emulsion 2)

| | | Fresh Responses | | | Raw Stock Stability 1 wk 120 F/50% vs. 1 wk 78 F/50% | | |
|---|---|---|---|---|---|---|---|
| Example | AF-1 (mg/M Ag) | Dmin | 0.15 Spd | Cntrst | Delta Dmin | Delta 15 Spd | % Cntrst loss |
| 35(Inv) | — | 0.07 | 251 | 0.78 | +0.08 | −5 | 13 |
| 36(Inv) | 0.682 | 0.08 | 248 | 0.75. | +0.08 | −7 | 10 |

Dye 1
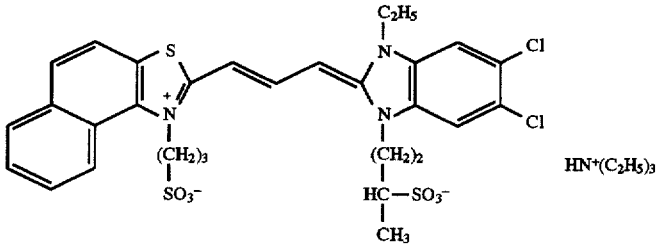
Dye 2
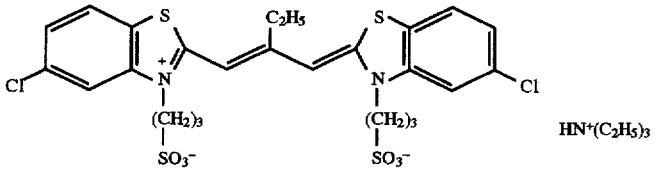
Dye 3
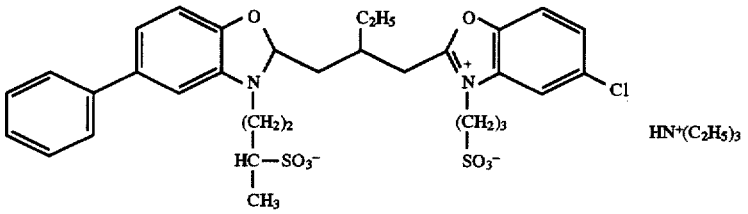
Dye 4
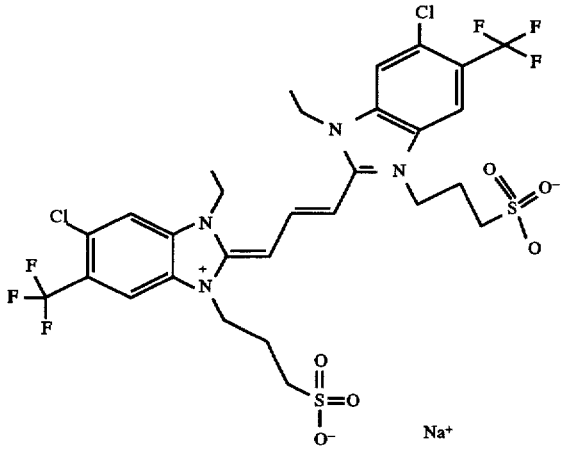
Dye 5
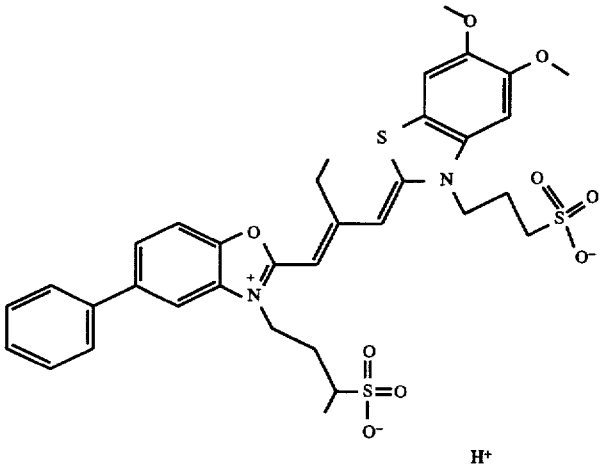

-continued
Coupler 1
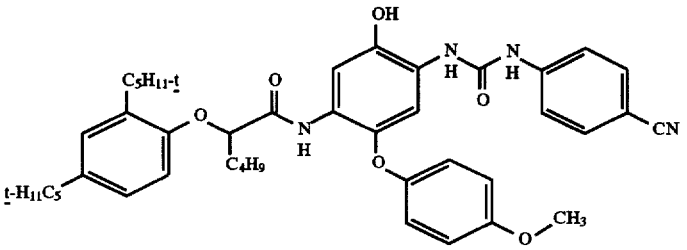
Coupler 2
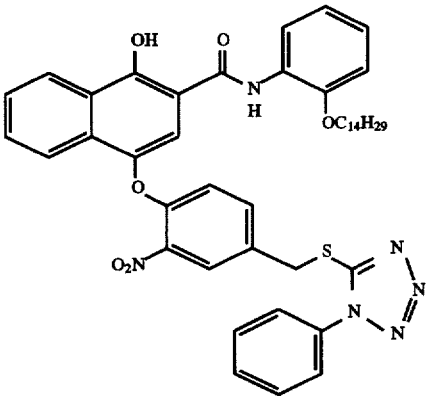
Coupler 3
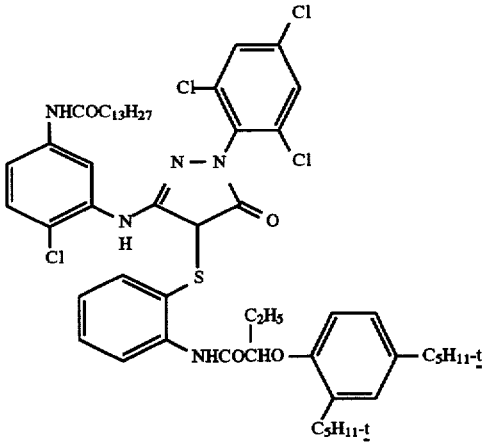
Coupler 4
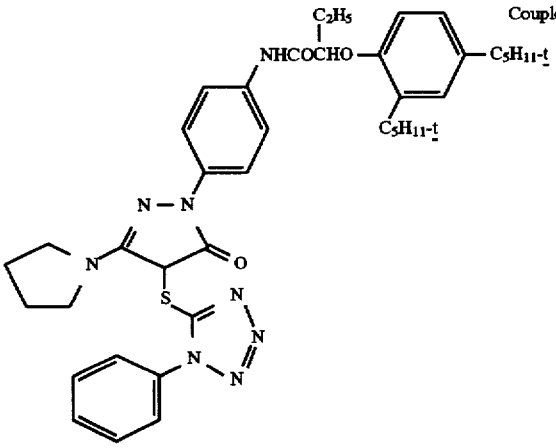
$Au_2S$
AF-1
4,5,6-triaminopyrimidine
AF-2
KI
AF-3
AF-4
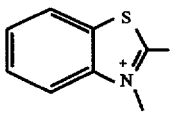
pTS⁻
pTS⁻ = para-toluenesulfate
AF-5
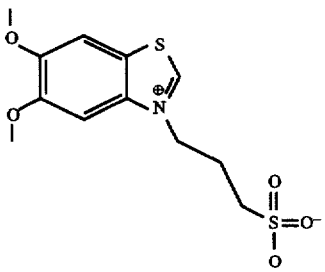

-continued
AF-6
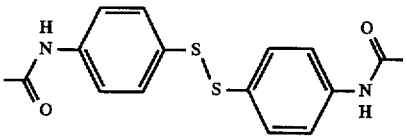
AF-7
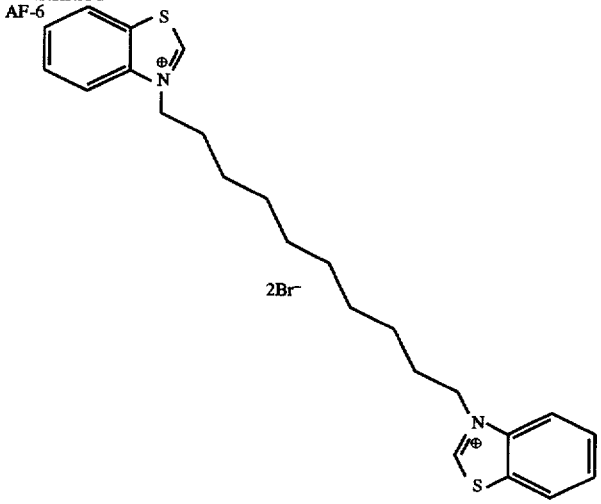
NaBr
AF-8
$Na^+$
AF-9
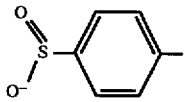
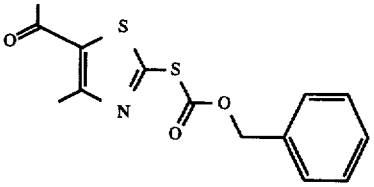
AF-10
$Na^+$
AF-11
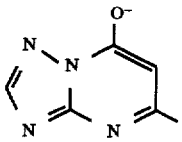
AF-12
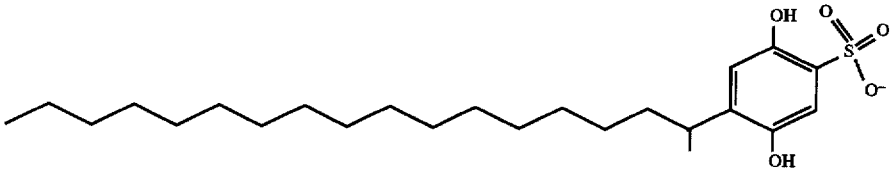
$Na^+$
$HN^+(C_2H_5)_3$
AF-13
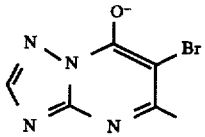
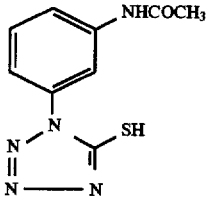
AF-14
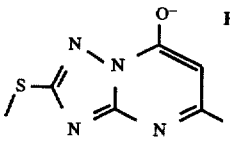
$HN^+(C_2H_5)$
AF-15
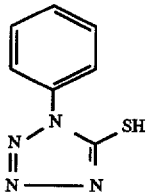
AF-16
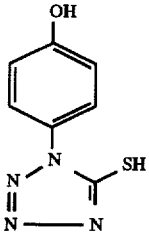
AF-17

The invention has been described in detail with particular reference to preferred embodiments thereof, but it will be understood that variations and modifications can be effected within the spirit and scope of the invention.

We claim:

1. An emulsion comprising tabular silver halide grains, sensitizing dye(s) and silver salt epitaxial deposits, and addenda that include a mercaptotetrazole and a tetraazaindene wherein said tabular silver halide grains comprise grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and a spectral sensitizing dye adsorbed to at least the major faces of the tabular grains, wherein the surface chemical sensitization sites include at least one silver salt epitaxially located on and confined to laterally displaced regions of said tabular grains.

2. The emulsion of claim 1 further comprising an organic dichalcogenide.

3. The emulsion of claim 1 further comprising chalcogenazolium.

4. The emulsion of claim 3 wherein said chalcogenazolium comprises a benzothiazole.

5. The emulsion of claim 1 further comprising a gold compound of low water solubility.

6. The emulsion of claim 5 wherein said gold compound comprises disulfide.

7. The emulsion of claim 1 wherein said tetraazaindene comprises

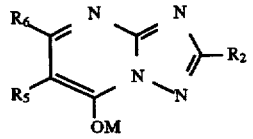

(I)

wherein $R_2$, $R_5$, and $R_6$ can independently be chosen from hydrogen, bromo, cyano, mercapto, carboxy, alkyl or substituted alkyl, unsubstituted or substituted aryl, where alkyl and aryl groups have 12 or fewer carbon atoms and can optionally be linked through a divalent oxygen or sulfur atom; and M is hydrogen, alkaline earth, or quaternized ammonium ion.

8. The emulsion of claim 7 wherein said mercaptotetrazole comprises

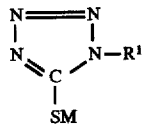

wherein

M is a cation of H, $NH_4$, or Na, and $R^1$ is an aliphatic or aromatic radical containing up to 20 carbon atoms.

9. The emulsion of claim 1 further comprising a palladium compound.

10. The emulsion of claim 1 wherein said mercaptotetrazole comprises 1-(3-acetamidophenyl)-5-mercaptotetrazole.

11. The emulsion of claim 10 wherein said tetraazaindene comprises

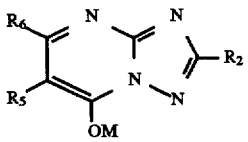

(I)

wherein $R_2$, $R_5$, and $R_6$ can independently be chosen from hydrogen, bromo, cyano, mercapto, carboxy, alkyl or substituted alkyl, unsubstituted or substituted aryl, where alkyl and aryl groups have 12 or fewer carbon atoms and can optionally be linked through a divalent oxygen or sulfur atom; and M is hydrogen, alkaline earth, or quaternized ammonium ion.

12. The emulsion of claim 1 wherein said tetraazaindene comprises at least one member selected from the group consisting of TAI, AF-13, and AF-15

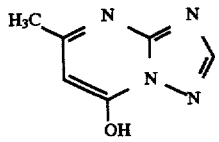

(TAI)

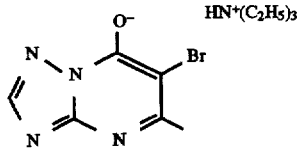

AF-13

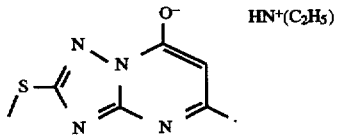

AF-15

13. The emulsion of claim 1 wherein said tetraazaindene has a pKa of less than 6.

14. The emulsion of claim 1 wherein said tetraazaindene comprises an anchor group that increases the affinity of said tetraazaindene for silver halide.

15. The emulsion of claim 1 wherein at least a portion of the tabular grains sufficient to improve speed-granularity relationships of the emulsion having a central region extending between said major faces, said central region having a lower concentration of iodide than a laterally displaced region also extending between said major faces and forming the edges and corners of the tabular grains.

16. The emulsion of claim 1 wherein the silver salt epitaxy (a) is of isomorphic face centered cubic crystal structure, (b) includes at least a 10 mole percent higher chloride ion concentration than the tabular grains, and (c) includes an iodide concentration that is increased by iodide addition during the epitaxy formation step.

17. The emulsion of claim 1 wherein the silver salt epitaxy contains a photographically useful metal ion dopant in which said metal ion displaces silver in the crystal lattice of the epitaxy, exhibits a positive valence of from 2 to 5, has its highest energy electron occupied molecular orbital filled and its lowest energy unoccupied molecular orbital at an energy level higher than the lowest energy conduction band of the silver halide lattice forming the-epitaxial protrusions.

18. The emulsion of claim 1 wherein said mercaptotetrazole is present in an amount between 0.00001 and 0.010 moles/mole silver.

19. The emulsion of claim 1 wherein said tetraazaindene is present in an amount between 0.0001 and 0.10 moles/mole silver.

20. The emulsion of claim 1 further comprising 2,5-dihydroxy-5-methyl-3-(1-piperidinyl)-2-cyclopentene-1-one.

* * * * *